US006055999A

United States Patent [19]

Grey

[11] Patent Number: 6,055,999

[45] Date of Patent: May 2, 2000

[54] COLLAPSIBLE DISPLAY FRAMEWORK FOR INDOOR OR OUTDOOR USE

[76] Inventor: Stephen Grey, Unit 1/54 Ghegwyn Street, Botany, NSW 2019, Australia

[21] Appl. No.: 08/973,632

[22] PCT Filed: Jun. 3, 1996

[86] PCT No.: PCT/AU96/00329

§ 371 Date: Jan. 22, 1998

§ 102(e) Date: Jan. 22, 1998

[87] PCT Pub. No.: WO96/41928

PCT Pub. Date: Dec. 27, 1996

[30] Foreign Application Priority Data

Jun. 9, 1995 [AU] Australia ..... 21623/95

[51] Int. Cl.[7] ..... E04H 15/50; E04H 15/46; E04B 1/344

[52] U.S. Cl. ..... 135/147; 135/143; 135/144; 135/158; 135/159; 52/646

[58] Field of Search ..... 135/121, 122, 135/123, 139–147, 151, 157–159, 128; 52/645, 646

[56] References Cited

U.S. PATENT DOCUMENTS 4,947,884 8/1990 Lynch .
5,485,863 1/1996 Carter ..... 135/151 X

FOREIGN PATENT DOCUMENTS 2110157 11/1971 Germany .
2519925 11/1976 Germany .
2520182 11/1976 Germany .
2521913 11/1976 Germany .
8907696 8/1989 WIPO .
9307113 7/1993 WIPO .
9424392 10/1994 WIPO .

*Primary Examiner*—Robert Canfield
*Attorney, Agent, or Firm*—Edwin D. Schindler

[57] ABSTRACT

A collapsible support structure for a covering. The support structure includes, at least, three apex poles with first ends pivotally connected together, so that, in use, the poles are able to be moved between a raised configuration, in which second opposite ends extend outwardly in different directions to create a pyramid-shaped frame and a collapsed configuration. The support structure also includes pairs of perimeter poles, with each pair forming an inverted "V" between the opposite ends of adjacent apex poles, when in the raised configuration, and a bracket device including struts, which extend between, and are pivotally attached to, respective apex poles intermediate their ends, along with a central flange element, in which the first connected ends of the apex poles and the central flange element may be pushed toward each other to obtain the raised configuration or pushed apart to obtain the collapsed configuration. The apex poles and the perimeter poles are pivotally connected so as to fold together into close, substantially parallel, positions when in the collapsed configuration. The covering is, preferably, attached to the support structure by a hook-and-loop attachment and the connected perimeter and apex poles are secured in an open position by a releasably operated telescopic brace device pivotally connected therebetween.

8 Claims, 8 Drawing Sheets

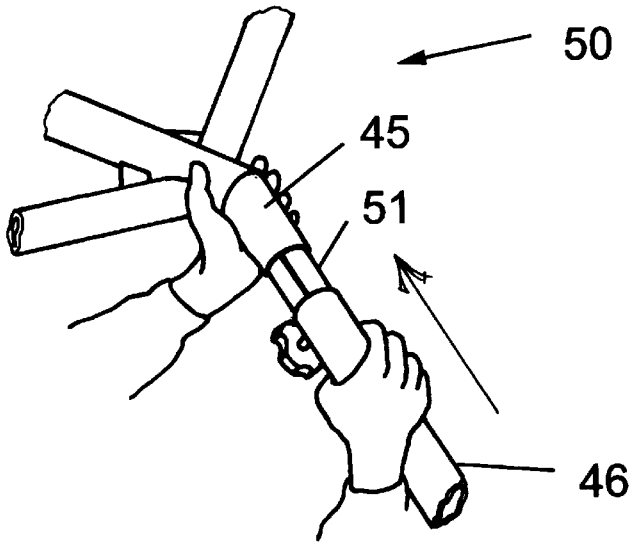
FIG. 9
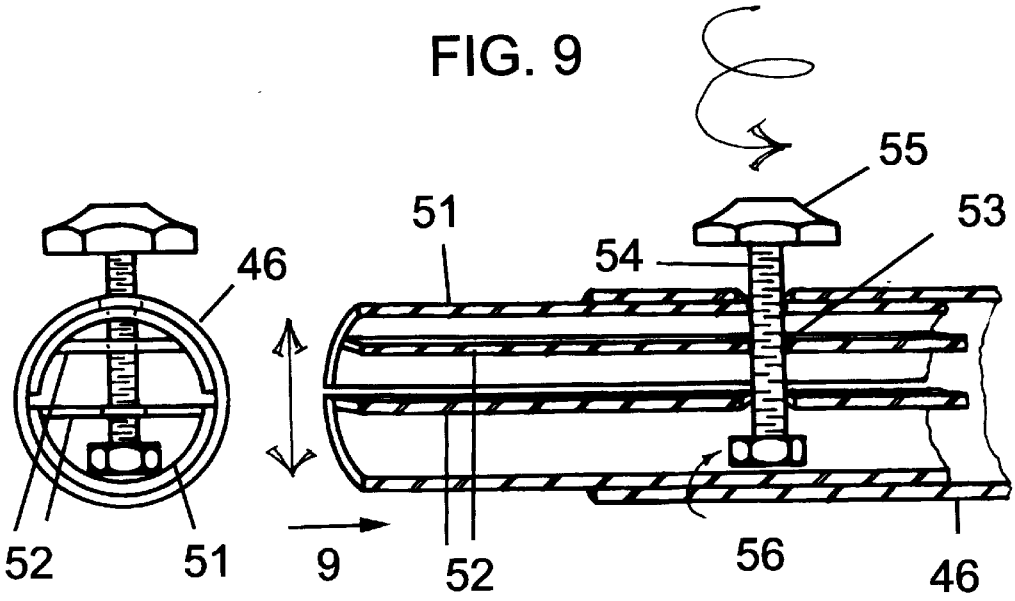
FIG. 11
FIG. 10

COLLAPSIBLE DISPLAY FRAMEWORK FOR INDOOR OR OUTDOOR USE

This invention relates to temporary or collapsible structures which may be used for example at indoor or outdoor sites or other places where an attractive short-term shelter is required.

BACKGROUND TO THE INVENTION

There are of course many types of tent-like structures used for temporary shelter. These range from simple rectangular steel frames loosely hung with canvas to the more elaborate structures. Such known apparatus however have the disadvantage of requiring a large number of separate parts which have to assembled on site. This of course is time consuming and requires the employment of expensive skilled labour. My co-pending Australian Application No. 52329/93 discloses arrangements which enables relative ease of assembly.

OBJECT OF THE INVENTION

It is therefore an object of this invention to ameliorate the aforementioned disadvantages and at the very least to provide an alternative to known arrangements.

DISCLOSURE OF THE INVENTION

Accordingly a relocatable collapsible support structure for a cover means is disclosed, said structure comprising at least three apex poles with first ends thereof pivotally connected together so that in use said apex poles are movable between a raised configuration in which the second opposite ends thereof extend outwardly in different directions to create a pyramid shaped frame and a collapsed configuration, and pairs of perimeter poles with each pair forming an inverted V between said opposite ends of adjacent apex poles when in said raised configuration so as to form together with said apex poles the aforesaid pyramid shaped frame and the apex poles and perimeter poles being pivotally connected so as to fold together into close substantially parallel positions when in the collapsed configuration and bracket means linking said apex poles intermediate said first and second ends said bracket means comprising braces which extend between and are pivotally attached to each apex pole and a central connector whereby the central connector may be pushed towards said first ends of said apex poles to obtain said raised configuration or away from said first ends to obtain said collapsed configuration and the bracket means including locking means for limiting movement of the central connector toward said first ends when in said raised configuration, wherein the connected perimeter and apex poles are secured in an open position by a releasably operated telescopic brace means pivotally connected therebetween.

According to another aspect there is disclosed a collapsible support structure for a cover means, said structure comprising at least three apex poles with first ends pivotally connected together so that in use said poles are moveable between a raised configuration in which the second opposite ends extend outwardly in different directions to create a pyramid shaped frame and a collapsed configuration, and pairs of perimeter poles with each pair forming an inverted V between said opposite ends of adjacent apex poles when in said raised configuration and bracket means comprising struts which extend between and are pivotally attached to respective apex poles intermediate their ends and a central flange means whereby the first connected ends of said apex poles and said central flange means may be pushed toward each other to obtain said raised configuration or pushed apart to obtain said collapsed configuration and said apex poles and perimeter poles being pivotally connected so as to fold together into close substantially parallel positions when in said collapsed configuration, wherein said cover means is attached to said support by hook and loop means.

BRIEF DESCRIPTION OF THE DRAWINGS

The currently preferred form of this invention will now be described with reference to the attached drawings in which:

FIG. 9 is a partial detailed perspective view of the connection between an apex pole, a sleeve member and a support leg showing its connection operation, FIG. 10 is a partial longitudinal cross-sectional view of the connection mechanism of FIG. 9, FIG. 11 is an end view looking in the direction of arrow 9 of FIG. 8.

BEST MODE OF CARRYING OUT THE INVENTION

Figure 1:
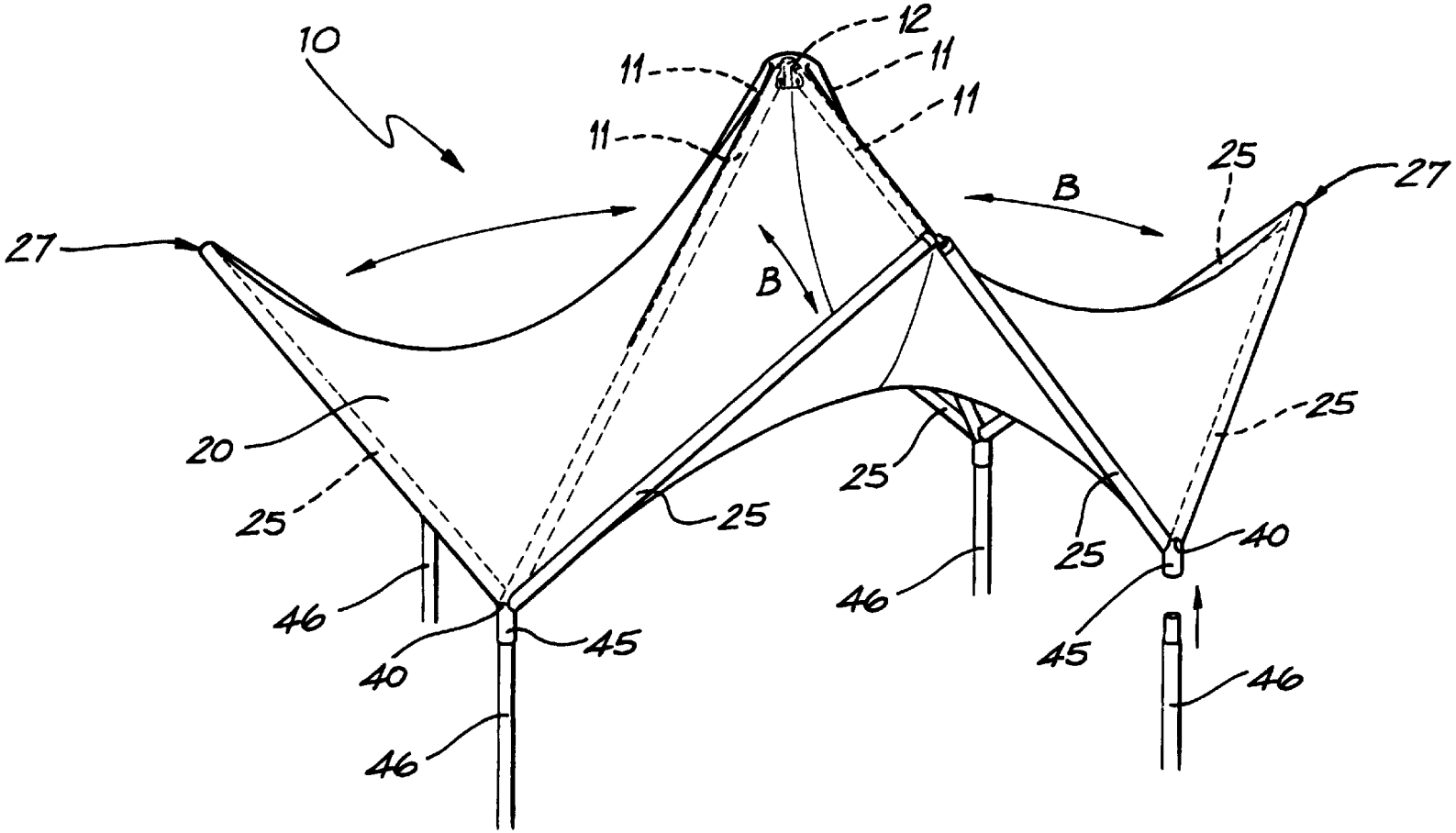
FIG. 1 is a perspective view of a structure according to this concept in the raised configuration.
Figure 2:
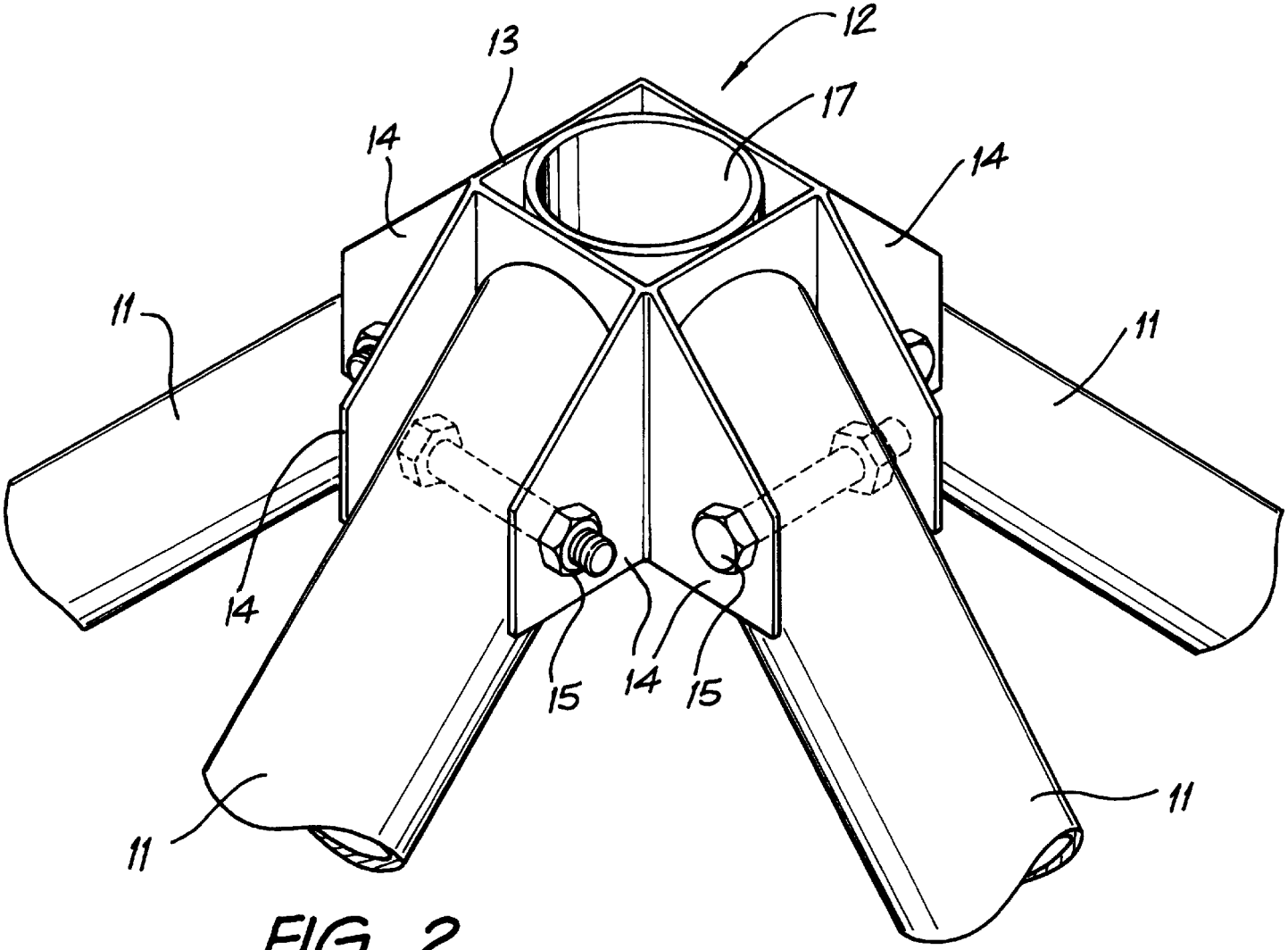
FIG. 2 is a detailed perspective view of a connecting bracket for connecting the ends of the apex poles together.
Figure 3:
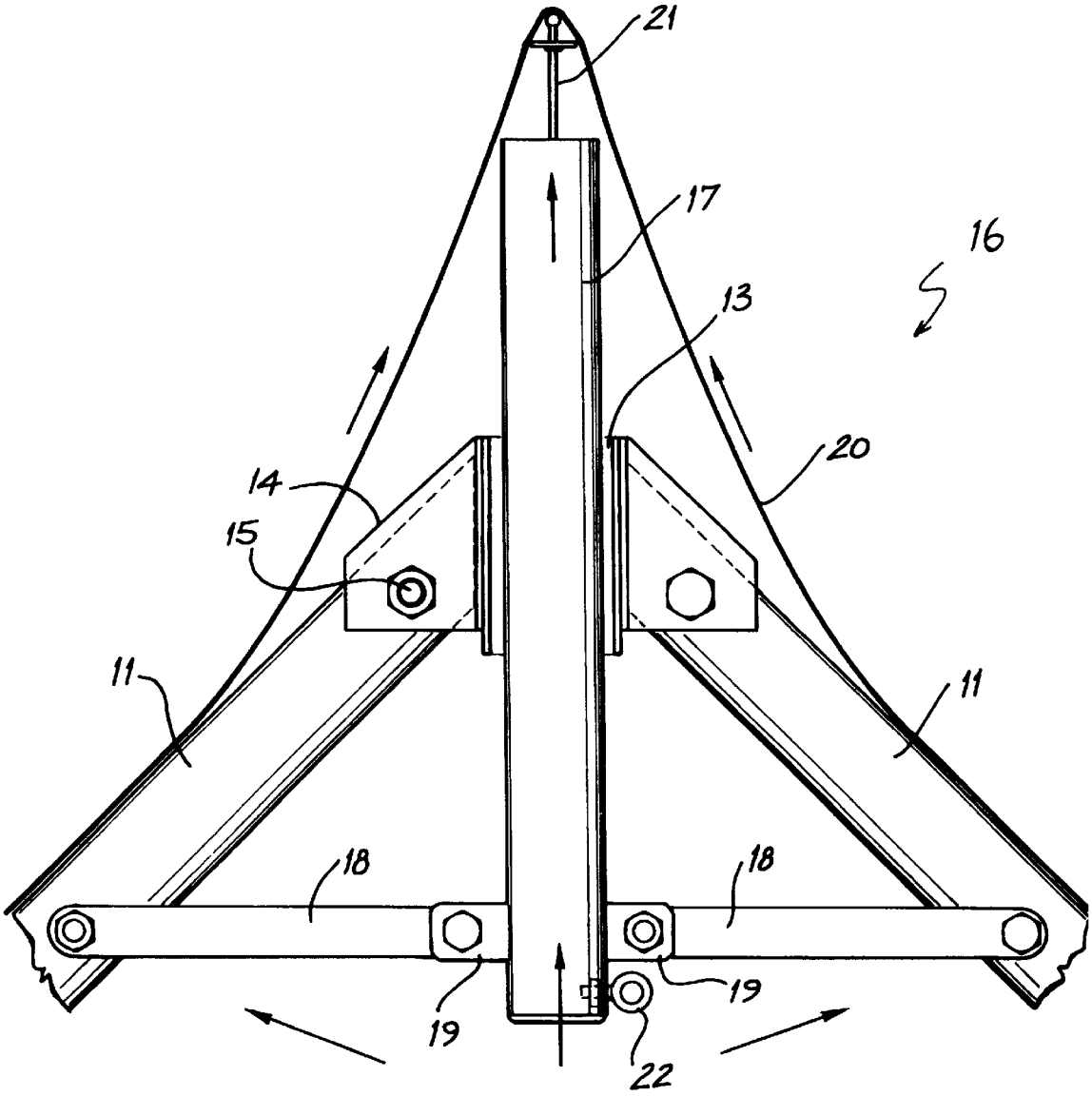
FIG. 3 is a cutaway side view of a mechanism for extending the apex poles out to their raised configuration using the connecting bracket of FIG. 2, with the structure in the raised configuration.
Figure 4:
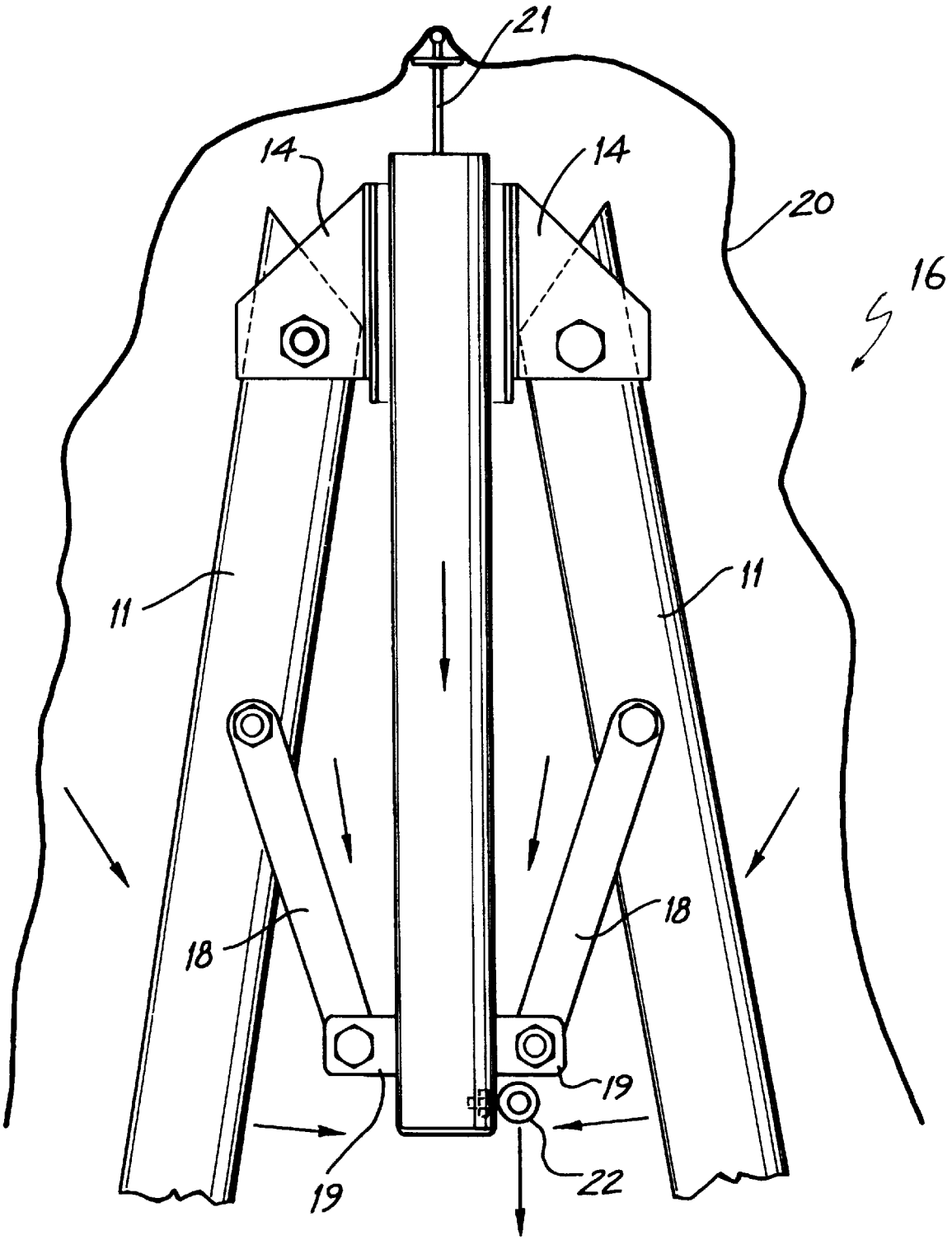
FIG. 4 is a cutaway side view of the mechanism of FIG. 3, with the structure in the collapsed configuration.

Referring first to FIG. 1 the structure 10 may in its raised configuration comprise four metal apex poles 11 which are joined together at their uppermost ends by a connector piece 12. In this case as shown with reference to FIGS. 2–4, the connector piece 12 for the uppermost ends of the apex poles 11 comprises a central square shaped slide member 13 having pairs of laterally extending wings 14 between which the ends of the apex poles 11 are hinged by transverse bolts 15. The ends of the apex poles 11 are preferably cut at an angle of 45° so as to engage the sides of the slide member 13 and limit the opening angle of the apex poles 11. Shown in FIGS. 3 and 4, is a centre bracket assembly 16 wherein the slide member 13 encloses a centre pole 17 which is slidable in the vertical direction as indicated by the arrows. Struts 18 link fixed flanges 19 on the centre pole 17 to respective apex poles 11 intermediate the ends thereof. The mechanism is therefore arranged such that the centre pole 17 may be moved relative to the connector piece 12 between the lower position shown in FIG. 3 where the apex poles 11 extend out and support a canopy 20 and the upper position shown in FIG. 4 where the apex poles 11 are folded inwardly toward the centre pole 17 and the canopy 20 is collapsed. A spigot 21 may be fitted to the top of the centre pole to form a neat and taut centre point for the raised canopy 20. Preferably an eye bolt 22 is also fitted adjacent the lower end of the centre pole to facilitate its vertical displacement using a hooked bar or the like.

Referring back to FIG. 1 it can be seen that pairs of perimeter poles 25 also extend laterally from the centre of the structure 10 in an inverted V between the outer ends 26 of the apex poles 11. These perimeter poles 25 together with the apex poles 11 thus define a central pyramid shaped frame with outwardly inclined wing sections on each side which may be used to support any suitable type of weatherproof covering or canopy 20.

Figure 5:
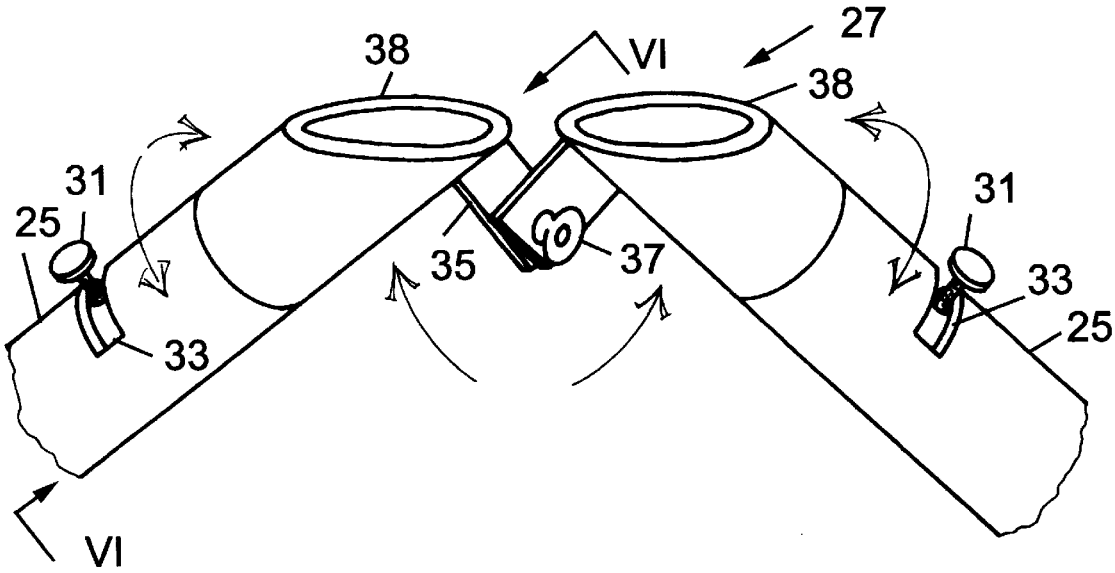
FIG. 5 is a detailed cutaway perspective view of the connection between the pairs of perimeter poles.
Figure 6:
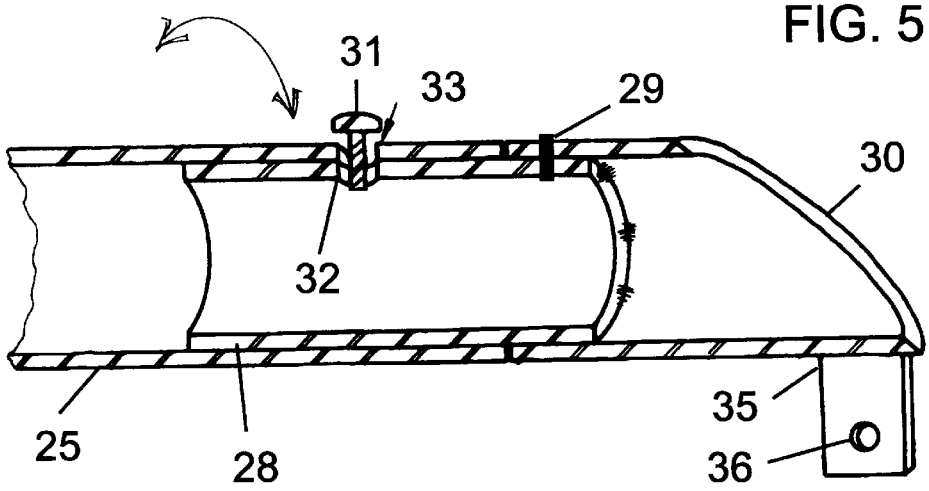
FIG. 6 is a longitudinal cross-sectional view along the lines VI—VI of FIG. 5.

A joint 27 between the ends of the perimeter poles 25 is shown in FIGS. 5 and 6. An inner sleeve 28 is received inside the end of each of the perimeter poles 25, and is connected by a rivet 29 to an end tube 30 which has substantially the same diameters as the perimeter poles 25. The inner sleeve 28 has a bolt 31 screwed into a hole 32 in its side with the bolt 31 passing through a transverse slot 33 in the perimeter pole 25. Thus the inner sleeve 28 and the fixedly connected end tube 30 are able to rotate relatively with respect to the perimeter pole 25 with the interaction between the bolt 31 and the slot 33 restricting the extent of the relative rotation. As the bolt 31 remains within the slot 33 and the end tube 30 is fixedly connected to the inner sleeve 28 the end tube 30 remains at the end of the perimeter pole 25.

Each of the end tubes 30 have a lug 35 extending laterally from its side towards the adjacent end tube 30. The lugs 35 each have a hole 36 through which an eye-bolt 37 passes thus pivotally connecting adjacent lugs 35 which in turn ensures that the perimeter poles 25 also pivot. It is noted that the end tubes 30 have bevelled free ends 38 which provide a tidy structure 10 when erected, The joint 27 allows the adjoining perimeter poles 25 to both hinge in the plane parallel to the poles and to partially rotate relative to each other to facilitate the opening and closing of the structure as described later.

Figure 7:
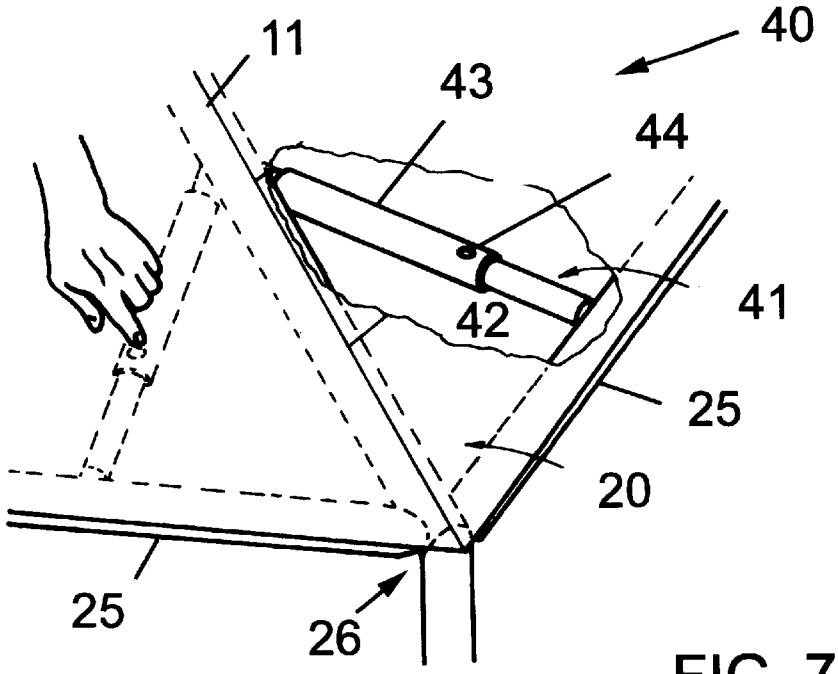
FIG. 7 is a partial cutaway perspective view of the connection between the outer ends of the apex poles and the perimeter poles showing the mechanism for the connection.
Figure 8:
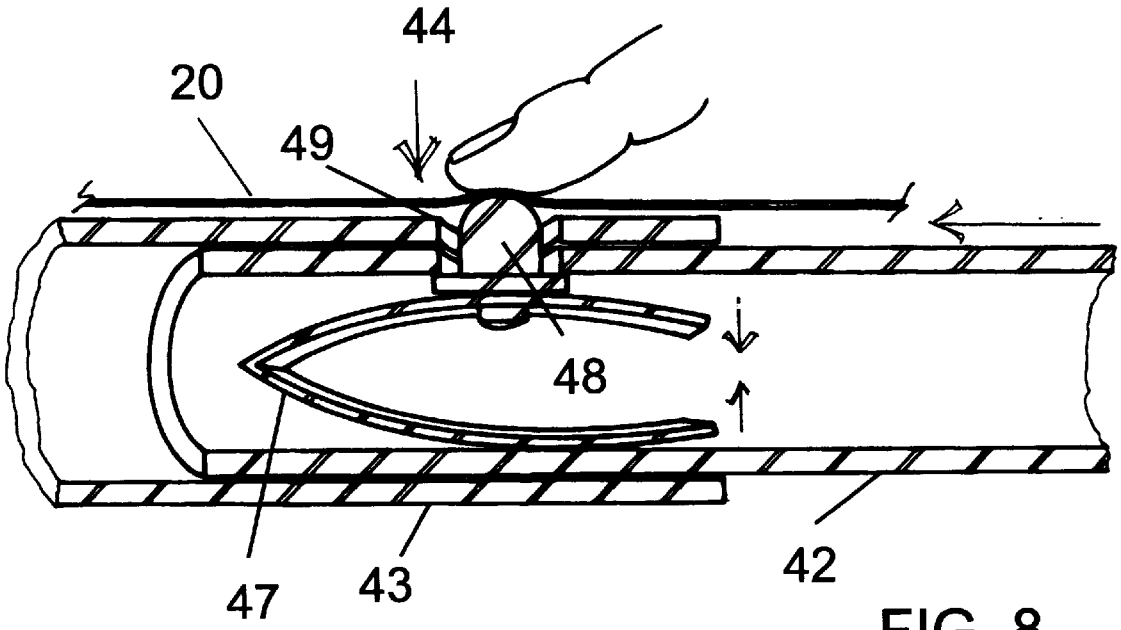
FIG. 8 is a partial longitudinal cross-sectional view of the mechanism of FIG. 7 showing its operation.

A joint 40 between the perimeter poles 25 and the outer ends 26 of the apex poles 11 is shown in FIGS. 7 and 8. Two perimeter poles 25 are pivotally connected to either side of the apex pole 11 by any suitable means of pivotal connection. It is preferable that the connection allows relative movement between the perimeter pole 25 and the apex pole 11 similar to the movement as previously described with reference to joint 27.

The joint 40 also includes a telescopic brace member 41 which is pivotally connected between the perimeter pole 25 and the apex pole 11. The brace member 41 includes a first tube 42 telescopically received within a second tube 43 with a push button release 44. The push button release 44 is spring operated by a butterfly spring 47 positioned within the tube 42, A push button 48 is urged into a pair of holes 49 in the tubes 42 and 43 when they are aligned at the erected configuration as illustrated in FIG. 8. As seen in FIGS. 7 and 8, the canopy 20 is adjacent the joint 40 when the structure 10 is in its erected configuration and the push button release 44 is able to be operated by pushing the button 48 while the canopy 20 is located abutting the button 48. Preferably, the location of the push button 48 is marked on the canopy 20 so that it can be easily found when the structure 10 is to be collapsed.

The push button release 44 is located on the top side of the brace member 41 so that it can be released easily by pushing the specific location of the canopy 20 without the need to remove or partially remove the canopy 20. When the push button release 44 is operated the telescopic brace member 41 shortens and the perimeter poles 25 are able to pivot relative to the apex pole 11 into a position substantially parallel thereto. Thus a strong and durable mechanism is provided to resiliently hold the perimeter poles 25 in their extended position as well as allowing ease of release which enables the perimeter poles 25 to be folded into a substantially parallel collapsed configuration.

A sleeve member 45 is fitted to each of the ends of the apex poles 11 adjacent the joint 40 to receive support legs 46 as shown in FIG. 1. An expander device 50 as illustrated in FIGS. 9–11 is preferably used to securely fit the support legs 46 to the sleeve member 45. The expander device 50 typically comprises a split tube 51 partially received within the top of the support leg 46 and partially receivable within the sleeve member 45. The split tube 51 has cross members 52 with threaded holes 53 located therein in which a threaded bolt 54 is threadedly received in. The threaded bolt 54 extends outside the support leg 46 and has a head 55 which can be manipulated to rotate the threaded bolt 54 and a nut 56 positioned within the split tube 51. When the split tube 51 is partially received within the sleeve member 45 the head 55 is twisted thus expanding the split tube 51 and securing the support leg 46 to the sleeve member 45.

Figure 12:
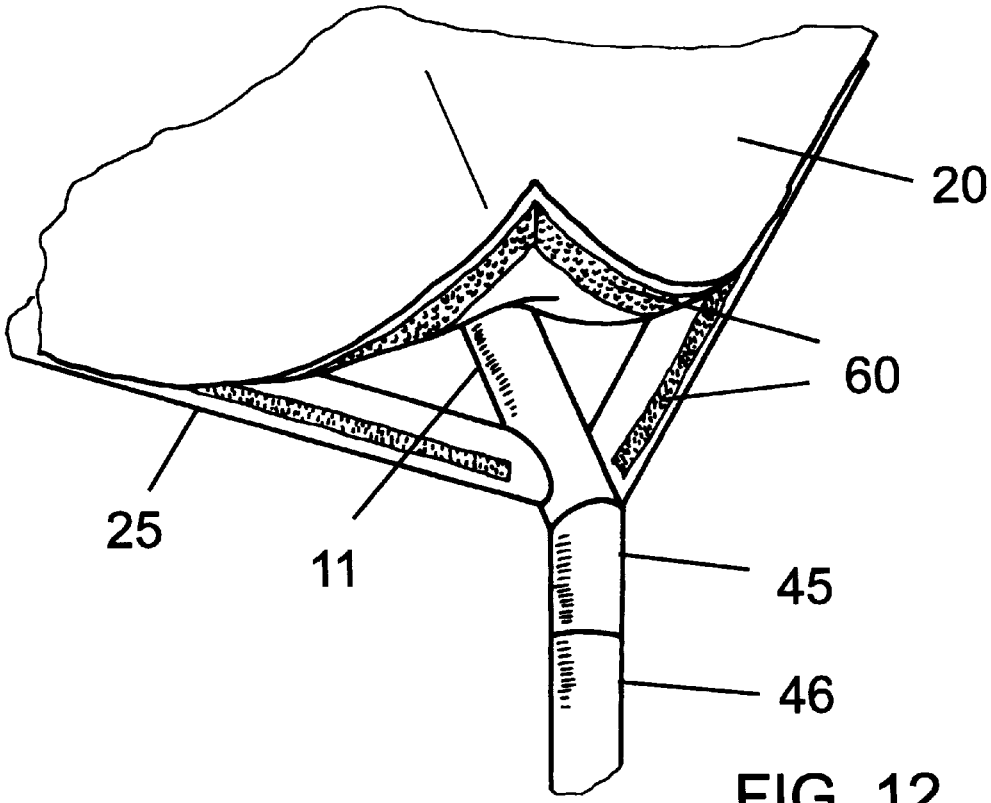
FIG. 12 is a partial cutaway perspective view of the connection between the outer ends of the apex poles and the perimeter poles showing the attachment means of the covering.
Figure 13:
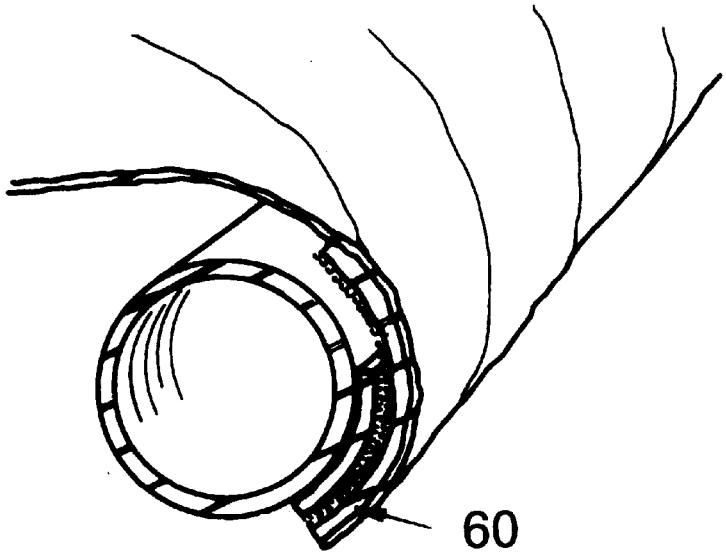
FIG. 13 is a detailed cutaway perspective view of a pole showing the attachment means of FIG. 12.

The canopy 20 is preferably attached to the apex poles 11 and the perimeter poles 25 by hook and loop connectors 60 as illustrated in FIGS. 12 and 13. This preferred arrangement enables the canopy 20 to be easily attached and detached without the need to disassemble the structure 10 as required by existing structures. In the preferred arrangement the hook and loop connectors 60 are in strip form along the poles 11,25, however it is possible that the hook and loop connectors 60 can be used in a number of ways to secure the canopy.

By virtue of the novel hinged joints between the apex poles 11 and the perimeter poles 25 the structure 10 in use may be transported to the desired location in the collapsed configuration, where the major structural components such as the apex poles 11 and the perimeter poles 25, while remaining connected, are conveniently bundled together in a compact substantially parallel configuration with the attached canopy 20 folded between them. On site the structure 10 is opened from this collapsed configuration by manipulating the centre bracket assembly 16 During opening of the structure 10 the bracket assembly 16 is used to spread the respective apex poles 11 apart to take the form of the central pyramid structure 10 shown in FIG. 1. The perimeter poles 25 are also simultaneously spread with the ends of the apex poles 11 to form an inverted V before being rotated outwardly (see FIG. 1 arrow B) and secured in place using the joint arrangements of FIGS. 5 and 6. The canopy 20 which is attached to the apex poles 11 and the perimeter poles 25, is thereby spread taut into a neat and attractive geometrical shape. The support legs 46 are then inserted into the sleeves 45 to elevate the stature 10.

After use the structure is easily collapsed again by pulling the bracket assembly 16 in the downward direction to unlock it, removing the support legs 46, folding the perimeter poles 25 inwardly towards the apex poles 11 and then pushing any two apex poles 11 towards the centre of the structure 10 whereupon all remaining apex and perimeter poles 11 and 25 will be drawn inward to close to a substantially parallel position with the canopy 20 folding between them.

It will thus be appreciated that this invention at least in the form of the embodiment described provides a novel and useful improvement in the structure of temporary shelters. Clearly however the example described is only the currently preferred form of this invention and a wide variety of modifications may be made which would be apparent to a person skilled in the art. For example the shape and configuration of the shelter when erected, the number of apex and perimeter poles used, the type of and method of fixing the cover material to the frame, the type of connectors for said poles and the method of connecting adjacent units may all be varied according to design preference. Also while it is preferred to use hollow aluminium poles the invention extends to any other suitable material.

I claim:

1. A collapsible support structure for a cover means, said structure comprising at least three apex poles with first ends pivotally connected together so that in use said poles are moveable between a raised configuration in which second opposite ends extend outwardly in different directions to create a pyramid shaped frame and a collapsed configuration, and pairs of perimeter poles with each pair forming an inverted V between said opposite ends of adjacent apex poles when in said raised configuration and bracket means comprising struts which extend between and are pivotally attached to respective apex poles intermediate their ends and a central flange means whereby the first connected ends of said apex poles and said central flange means may be pushed toward each other to obtain said raised configuration or pushed apart to obtain said collapsed configuration and said apex poles and perimeter poles being pivotally connected so as to fold together into close substantially parallel positions when in said collapsed configuration, wherein the connected perimeter and apex poles are secured in an open position by a relesably operated telescopic brace means pivotally connected therebetween.

2. The support structure as claimed in claim 1, wherein said releasably operated telescopic brace means is adapted to be operated from above the cover means when said cover means is attached to said structure and said releasably operated telescopic brace means is positioned below said cover means when said cover means is attached to said structure.

3. The support structure as claimed in claim 2, wherein said releasably operated telescopic brace means is operated by a push button release means adapted to be positioned adjacent or abutting against said cover means.

4. The support structure as claimed in any claim 1, wherein the connections between the pairs of perimeter poles comprise pairs of laterally extending lugs which are fitted to the poles adjacent their ends, the outer ends of the lugs being pivotally connected by a bolt or pin, wherein each said end of said perimeter poles includes a sleeve rotatable within said perimeter pole so that said adjoining pairs of perimeter poles can rotate relative to each other.

5. The support structure as claimed in claim 1, wherein the second opposite ends of the apex poles are adapted to removably connect with support legs by angled sleeves.

6. The support structure as claimed in claim 5, wherein an expander device is provided to securely connect said support legs to said angled sleeves.

7. The support structure as claimed in claim 1, wherein said cover means is attached to said support structure by hook and loop means.

8. A collapsible support structure and cover means therefor: comprising cover means and a support, said support structure having at least three apex poles with first ends pivotally connected together so that, in use, said apex poles are moveable between a raised configuration in which second opposite ends extend outwardly in different directions to create a pyramid shaped frame and a collapsed configuration, and pairs of perimeter poles with each pair forming an inverted V between said opposite ends of adjacent apex poles when in said raised configuration, and bracket means comprising struts extending between, and are pivotally attached to, respective apex poles intermediate their ends and central flange means whereby the first connected ends of said apex poles and said central flange means are capable of being pushed toward each other for obtaining said raised configuration or pushed apart for obtaining said collapsed configurations said apex poles and perimeter poles being pivotally connected so as to fold together into close substantially parallel positions when in said collapsed configuration, wherein said cover means is attached to said support structure by hook and loop means.

* * * * *